US007785403B2

(12) United States Patent
Ouyang et al.

(10) Patent No.: US 7,785,403 B2
(45) Date of Patent: Aug. 31, 2010

(54) AIR PURIFIER

(76) Inventors: Chieh Ouyang, No. 36, Lane 130, Yixin 1 St., Yangmei Town, Taoyuan County 326 (TW); Wei Ouyang, 1F., No. 12, Alley 49, Lane 115, Sec. 2, Chenggong Rd., Neihu District, Taipei City 114 (TW)

( * ) Notice: Subject to any disclaimer, the term of this patent is extended or adjusted under 35 U.S.C. 154(b) by 375 days.

(21) Appl. No.: 11/843,176

(22) Filed: Aug. 22, 2007

(65) Prior Publication Data

US 2008/0047433 A1 Feb. 28, 2008

(30) Foreign Application Priority Data

Aug. 25, 2006 (TW) ..... 95131399 A

(51) Int. Cl.
*B03C 3/10* (2006.01)
*B03C 3/68* (2006.01)

(52) U.S. Cl. ..... 96/18; 55/DIG. 38; 95/3; 96/19; 96/94; 96/97

(58) Field of Classification Search ..... 96/18–26, 96/94, 97, 98; 95/2–7, 77; 55/DIG. 38
See application file for complete search history.

(56) References Cited

U.S. PATENT DOCUMENTS

| | | | | | |
|---|---|---|---|---|---|
| 1,396,811 | A * | 11/1921 | Chubb | 95/77 |
| 2,055,368 | A * | 9/1936 | Shively | 204/170 |
| 2,209,798 | A * | 7/1940 | Subkow | 208/350 |
| 3,856,476 | A * | 12/1974 | De Seversky | 422/111 |
| 5,163,983 | A * | 11/1992 | Lee | 96/22 |
| 5,518,531 | A * | 5/1996 | Joannu | 96/55 |
| 6,368,392 | B1 * | 4/2002 | Ohtake et al. | 96/65 |
| 6,506,238 | B1 * | 1/2003 | Endo | 96/79 |
| 6,508,982 | B1 * | 1/2003 | Shoji | 422/22 |
| 6,679,940 | B1 * | 1/2004 | Oda | 96/55 |
| 6,858,064 | B2 * | 2/2005 | Bologa et al. | 95/65 |
| 6,958,088 | B1 * | 10/2005 | Moriyama | 96/39 |
| 7,311,762 | B2 * | 12/2007 | Taylor et al. | 96/39 |
| 2004/0187681 | A1 * | 9/2004 | Kishioka | 95/57 |
| 2005/0126392 | A1 * | 6/2005 | Wascher et al. | 95/65 |
| 2008/0196590 | A1 * | 8/2008 | Bologa et al. | 96/88 |

FOREIGN PATENT DOCUMENTS

| | | | | |
|---|---|---|---|---|
| JP | 53-130585 | A * | 11/1978 | 96/97 |
| JP | 4-150961 | A * | 5/1992 | 96/94 |

* cited by examiner

*Primary Examiner*—Richard L Chiesa
(74) *Attorney, Agent, or Firm*—Rosenberg, Klein & Lee

(57) ABSTRACT

An air purifier includes a main frame, a discharging device, a dust collection device and a voltage generator. The discharging device has a discharging portion and is installed in the main frame. The dust collection device has a dust collection portion and is installed in one side of the discharging device. The air purifier can produce ozone, negative ions and static electricity by moving the discharging portion and the dust collection portion and receiving suitable voltage. The voltage generator, the discharging portion, and the dust collection portion accomplish conduction. Production of ozone, negative ions and static electricity occurs according to separation between the discharging portion and dust collection portion, as well as the particular environment of operation, thereby improving air quality.

20 Claims, 4 Drawing Sheets

AIR PURIFIER

BACKGROUND OF THE INVENTION

1. Field of the Invention

The present invention relates to an air purifier; particularly to an air purifier capable of releasing ozone, negative ions and static electricity.

2. Background of the Invention

As the level of living grows, people ask higher and higher quality of surrounding environment air. On the contrary, due to the increase of population density, industrial production, construction and auto exhaust, dust and the germs increase, the ozone layer is damaged and the negative ions, which are helpful to the human body, decrease correspondingly.

From another point of view, animals also need a high level of air and environment quality. When a livestock farm is full of odors, which might be from garbage, excrement or other contamination, animals will have slow growth. Besides, contamination will pollute the livestock per se: harmful bacteria caused thereby will pollute the meat quality. The dust generated by treading of livestock also harms their growth.

SUMMARY OF THE INVENTION

The primary object of the invention is therefore to specify an air purifier that can produce ozone, negative ions and static electricity, in order to clean the air.

According to the invention, the object is achieved to provide an air purifier, which includes a main frame, a discharging device installed in the main frame and having a discharging portion, a dust collection device installed at a lateral side of the discharging device and having a dust collection portion, and a voltage generator electrically conducting the discharging portion and the dust collection portion. The dust collection portion is capable of motion relative to the discharging portion; the electrical connection between the discharging portion and the dust collection portion is selectively activated.

By adjusting the relative distance between the discharging portion and the dust collection portion and switching the connection between the voltage generator and the dust collection portion, various voltages can be applied to generate and release ozone, negative ions and static electricity to collect dust. The air purifier according to the present invention has simple structure for easy application, such as a living environment, livestock farm etc., and provides improved fresh air.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1:
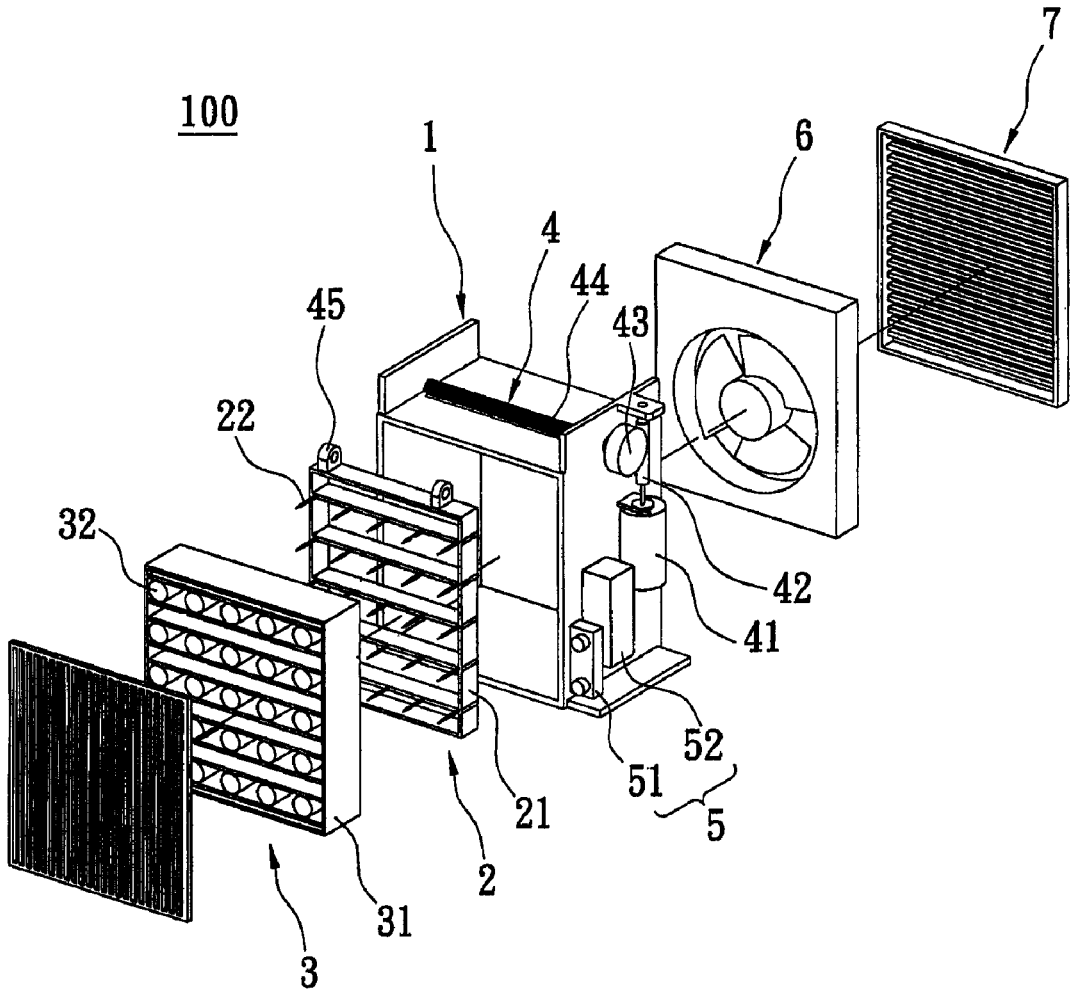
FIG. 1 is a decomposition view of an air purifier according to the present invention.

As illustration in FIG. 1, an air purifier 100 is provided for living environment, livestock farm etc., in order to generate and release ozone, negative ions and static electricity to collect dust and to get improved fresh air. The air purifier 100 includes a main frame 1, a discharging device 2, a dust collection device 3, a driving mechanism 4 and a circuit control unit 5.

The main frame 1 is firm enough for disposing in an appropriate reach. The discharging device 2 is arranged in the main frame 1. The dust collection device 3 is arranged at a lateral side of the discharging device 2. The discharging device 2 includes a first framework 21, which is substantially rectangular and has a discharging portion 22. There are plenty of the discharging portions 22 disposed in the first framework 21 in an equidistant way. The dust collection device 3 includes a second framework 31, which is substantially rectangular and has a dust collection portion 32. The dust collection portion 32 is hollow. There are also plenty of the dust collection portions 32 disposed in the second framework 31. The discharging portion 22 and the dust collection portion 32 move relative to each other. The discharging portion 22 can move into the corresponding dust collection portion 32. The dust collection portion 32 can be a cylindrical or rectangular, and half closed framework; the discharging portion 22 can be an elongated metal element or a metallic silk.

In addition, the main frame 1 further includes a fan device 6 for draining or entering the air, and a front/rear filter 7 for purifying the dust or miscellaneous articles in the air. The fan device 6 is an axial fan and connected to the circuit control unit 5 electrically. The discharging device 2, the dust collection device 3, the fan device 6 and the filter 7 can be assembled to the main frame 1 in sequence.

The driving mechanism 4 is further applied to the main frame 1, in order to move the discharging device 2 relative to the dust collection device 3. The driving mechanism 4 includes a motor 41 arranged on an exterior portion of the main frame 1, a first driving member 42, such as a worm, connected to and driven by the motor 1, a second driving member 43, such as a worm gear, connected to and meshed with the first driving member 42, a rotation member 44, such as a rack rod or screw rod, connected in the second member 43 and pivoted to the main frame 1, and two joint members 45, such as screws or racks, equidistant on the first framework 21 of the discharging device 2 to connect with the rotation member 44. For the further description, the screw can be joined with the screw rod and the rack can mesh with the rack rod. When the motor 41 is powered, the first driving member 42, the second driving member 43, the rotation member 44 and the joint members 45 are driven sequentially, thereby the discharging portion 22 of the discharging device 2 can move inside the dust collection portion 32 of the dust collection device 3.

The circuit control device 5 is disposed at an appropriate portion of the main frame 1, and electrically connected to the discharging device 2, the dust collection device 3, the driving mechanism 4 and the fan device 6. Thus, the power of the dust collection device 3 can be switched, the voltage of the discharging device 2 can be controlled, and the motion of the driving mechanism 4 and the fan device 6 can be controlled. The circuit control unit 5 includes a sensor 51 for detecting air, a circuit controller 52, and a voltage generator (not shown) electrically connected to the sensor 51 and the circuit controller 52. The circuit controller 52 has a circuit board disposed inside, chips and electrical components for controlling the discharging device 2, the dust collection device 3, the driving mechanism 4 and the fan device 6. The voltage generator electrically connects with the discharging portion 22 and the dust collection portion 32. For further description, the sensor 51 detects the quality of air and senses whether there is a human present. After the information the sensor 51 gained is delivered to the circuit controller 52, which can drive the motor 41 after judging the information according to a predetermined program, the discharging portion 42 can move forward or backward. At the same time, the voltage generator can be controlled for outputting to the discharging portion 22 and the dust collection portion 32, so that the fan device 6 can be operated. The discharging portion 22 and the dust collection portion 32 conduct to positive and negative electrodes alternatively. By the outputting voltage, the discharging portion 22 and the dust collection portion 32 can generate high voltage or transform a higher voltage to a lower voltage. For example, a 100,000 volts voltage can be generated, or a 100,000 volts higher voltage can be transformed to a 50,000 volts lower voltage.

Figure 2:
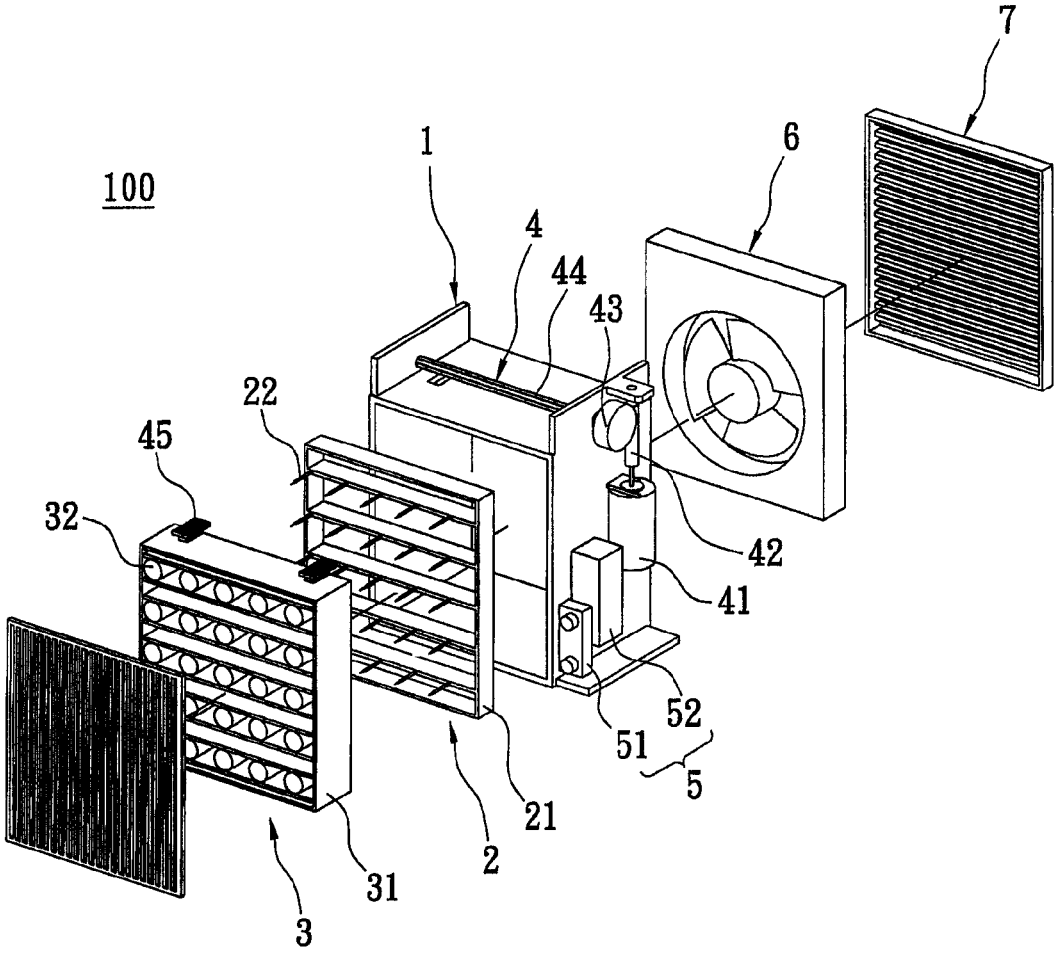
FIG. 2 is a decomposition profile of the air purifier according to another embodiment of the present invention.

By moving the dust collection device 3 can accomplish the effects mentioned above. The joint member 45 illustrated in FIG. 2 can be arranged under the second framework 31 of the collection device 3. The joint member 45 connects with the rotation member 44, which can force the dust collection device forward or backward. The dust collection portion 32 can be moved relative to the discharging portion 22. The discharging portion 22 can move upward and downward, forward and backward, or leftward and rightward, in order to be staggered with and moved relative to the dust collection portion 32. An electromagnetic valve (not shown) can be further provided to connect with the dust collection device 3 or the discharging device 2, thus the discharging portion 22 and the dust collection portion 32 can move relative to each other.

Please refer to the table mentioned below: when the relative motion between the discharging portion 22 and the dust collection portion changes because the discharging portion 22 and the dust collection portion 32 electrically connect with the voltage generator, the voltage from the voltage generator can make the discharging portion 22 and the dust collection portion 32 generate high voltages or to transform high voltages to low voltages. Therefore, the high or low voltages generated thereby can generate ozone, release negative ions, and collect dust.

| No | Effect | Position: Rectangular | Position: Cylindrical | Voltage (between opposite electrodes of voltage generator) | On/Off (between the voltage and the dust collection portion) |
|---|---|---|---|---|---|
| 1 | Ozone | Stretch in Position A | Stretch in Position A | Voltage to release ozone | On |
| 2 | Concentrated negative ions | Position B | Position B | Voltage to release concentrated negative ions | Off |
| 3 | Dust collection via static electricity | Position C | Position C | Voltage to release static electricity | On |
| 4 | Fresh negative ions | Position D | Position D | Voltage to release negative ions | Off |

Here are procedures for generating ozone, negative ions and static electricity.

1. Ozone:

The sensor 51 of the circuit control unit 5 can detect the quality of environment air. When the value of the air quality is so bad and worse than a predetermined criterion, the circuit controller 52 drives the motor 41. The discharging portion 22 of the discharging device 2 and the dust collection portion 32 of the dust collection device 3 approach each other thereby, and the discharging portion 22 can stretch into the dust collection portion 32. While the discharging portion 22 is in the dust collection portion 32, high voltages can be applied to both of the two, the air will be ionized due to the high voltage, and ozone will be formed and released.

Ozone is a powerful oxidizing agent and can be used for bleaching substances and for killing bacteria, such as colon bacillus, bacillus cereus, bacillus megatherium, *Shigella dysenteriae, Salmonella typhi*, meningococcus, *Staphylococcus aureaus, salmonella*, flu virus, hepatitis virus, etc.

In addition, there are foul smells in a livestock farm. By using ozone to freshen the air and eliminate smells, the chemical structure of the foul-smelling substances will be broken down resulting in disinfected, clean substances. In the decomposition process of ozone, gases, such as carbon monoxide or sulphurous compounds, ammonia or the like, will become static, clean fresh air in a short time.

2. Concentrated Negative Ions:

When the discharging portion 22 and the dust collection portion 32 are far away from each other, concentrated negative ions will be released after high voltages are exerted on the discharging portion 22 and there is electrical disconnection between the voltage generator and the dust collection portion 32. The concentrated negative ions will combine with particles of smoke or dust, so that the particles of smoke or dust will be charged and absorbed by the ground. The air will be clean after the particles drop. There are some advantages about negative ions:

5. To increase lung function of living creatures: by breathing negative ions for 30 minutes, oxygen intake capability will increase 20% and carbon dioxide output capability raise 14.5%.
6. To improve the heart muscles: by acting with negative ions, the cardiovascular system will improve and the blood pressure will be lowered.
7. To improve sleep: negative ions will relax the nervous system, adjust carnosine corpus metabolism and increase the disease-resistant capability.
8. To kill bacteria: negative ions will alter the structure of germs, leading to their death.

3. Dust Collection Via Static Electricity

When the discharging portion 22 approaches the dust collection portion 32, both of the two have low voltages applied to them, and a low-voltage static electricity field between the two is formed. The air in the field will be ionized and then attached to contaminated particles, which will be charged thereby to be absorbed by the electrode having opposite polarity. Most contaminated matter moves forward to an inner wall of the dust collection portion 32. The inner wall of the dust collection portion 32 can be cleaned if the layer of the matter deposited is too thick. Furthermore, a dust absorption metal layer (not shown) can be provided in the dust collection portion 32. When the contaminated matter is received into the dust collection portion 32 via the filter 7 for removing large particles by the fan device 6, the matter can touch the metal layer completely and be cleaned by the effect of the static electricity.

4. Fresh Negative Ions

When the discharging portion 22 is far away from the dust collection portion 32, the discharging portion 22 can be applied with a high-voltage, direct current power for generating the corona and rapidly releasing electrons in high speed. These electrons will catch oxygen or the like to form negative ions to freshen the air.

Figure 3:
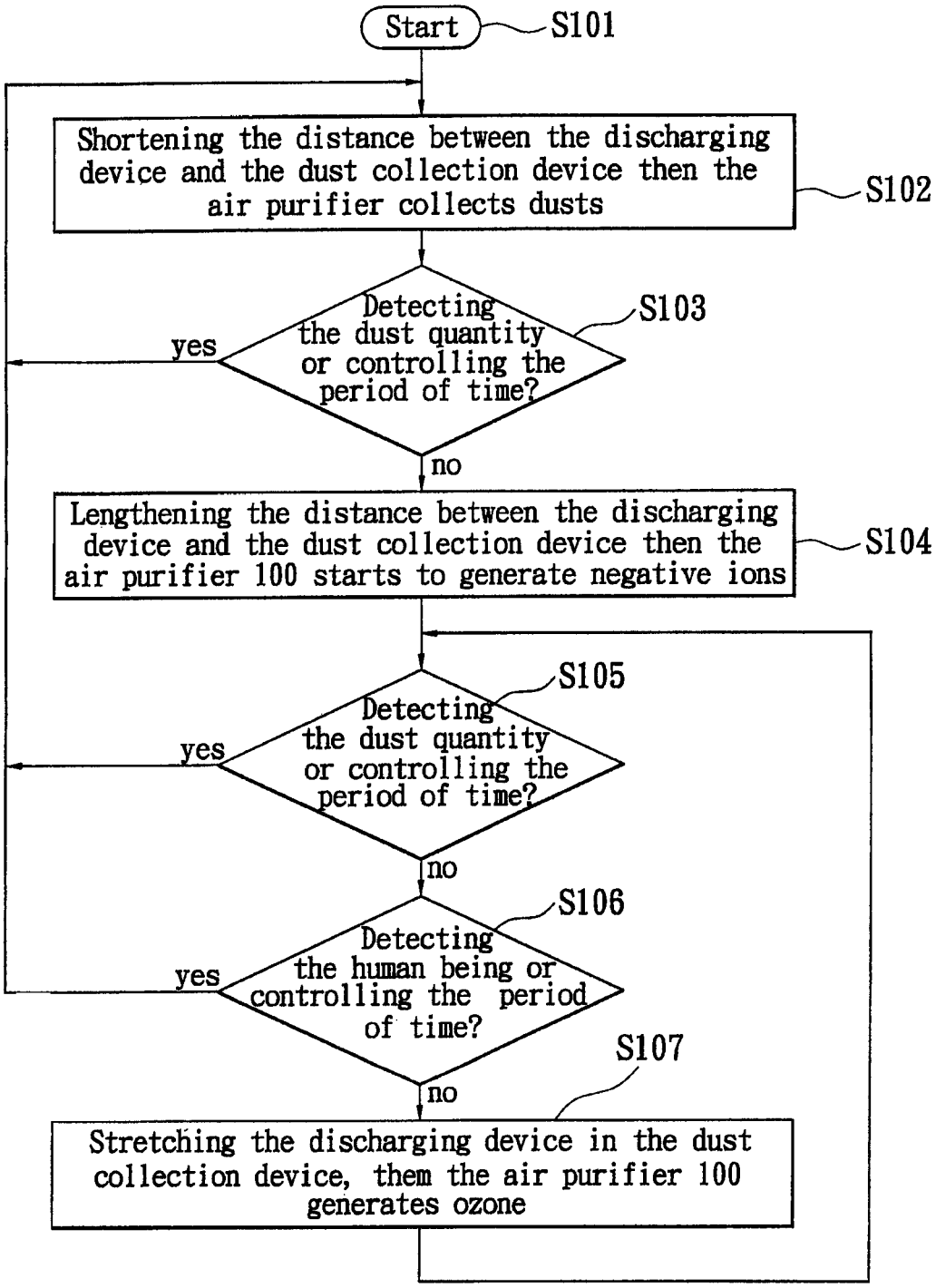
FIG. 3 is a flow chart of the air purifier according to the present invention.

The air purifier according to the present invention can be controlled by programming procedures and applied to the living environment or the livestock farm. FIG. 3 shows procedures for applying the air purifier to the living environment. Here are the descriptions about the procedures:

1. Starting up the air purifier 100 (S101), and then the air purifier collects dusts (S102);

2. By detecting whether the dust quantity in the air is decreased via the sensor 51 or by controlling the period of time of the circuit controller 52 (S103), the sensor 51 judges if the dust quantity in the air matches the standard criteria or not. If the dust quantity in the air is higher than the standard, then operation goes back to the step (S102). If the dust quantity in the air can meet the standard, then the air purifier 100 starts to generate negative ions (S104);

3. By further detecting whether the dust quantity in the air is decreased via the sensor 51 or by controlling the period of time of the circuit controller 52 (S105), the sensor 51 judges if the dust quantity in the air matches a predetermined criteria or not. If the dust quantity in the air is higher than the predetermined criteria, then operation goes back to the step (S102). If the dust quantity in the air can meet the predetermined criteria, then the air purifier 100 keeps generating negative ions for a while;

4. After the controlled period of time of the circuit controller 52, the air purifier 100 starts to generate ozone (S107), or by detecting whether anybody is in this environment via the sensor 51 (S106). If someone is in this environment, then operation goes back to the step (S102), or the air purifier 100 generates ozone for a while and then go back to step (S105).

Figure 4:
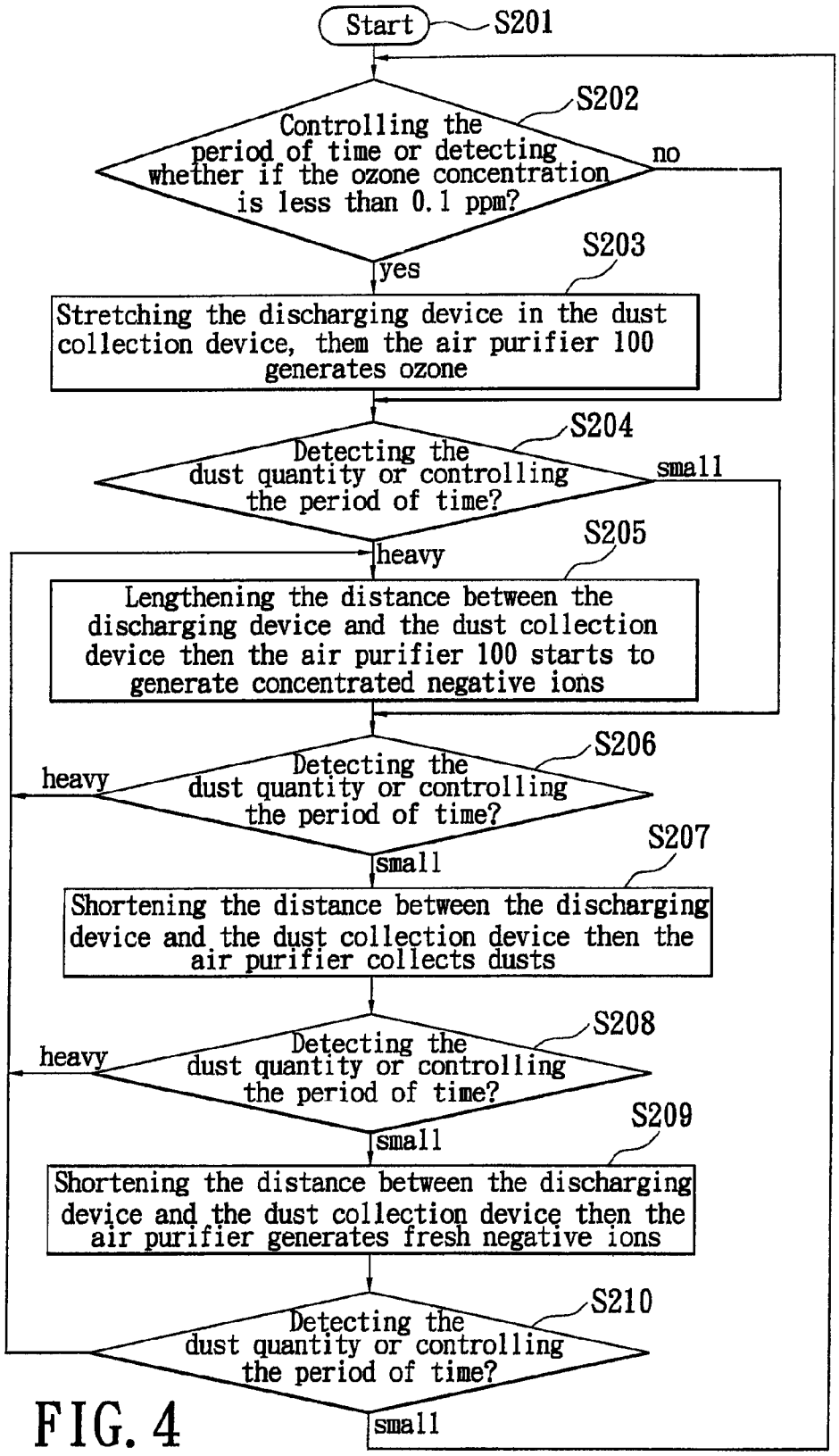
FIG. 4 is a flow chart of the air purifier according to another embodiment of the present invention.

FIG. 4 shows procedures of the air purifier applied for the livestock farm. Here are the descriptions about the procedures:

1. Starting up the air purifier 100 (S201), for detecting whether the ozone concentration in the air or controlling the period of time via the sensor 51 or the circuit controller 52 (S202);

2. If the ozone concentration is less than 0.1 ppm (part per million), then the air purifier generates ozone (S203) and detects the dust quantity in the air via the sensor 51 or the circuit controller 52 after an appropriate period of time (S204). If the ozone concentration is more than 0.1 ppm, then skip step (S203) and the procedure goes to step (S204). If someone is found in this environment, then the procedure goes to step (S204) directly for preventing the person from the effects of concentrated ozone;

3. In step (S204), if the dust quantity in the air is so heavy the air purifier 100 generates concentrated negative ions (S205) for a while, and then the air purifier 100 detects the air (S206). If the dust quantity in the air is small then the procedure goes to step (S206). Alternatively, the circuit controller 52 can control the appropriate period of time and then the procedure goes to step (S205), and after a while the procedure goes to step (S206);

4. In step (S206), if the dust quantity in the air increases, then the procedure goes to step (S205); if not, the air purifier 100 start to generate static electricity for dust collection (S207). Alternatively, the circuit controller 52 can control the appropriate period of time and then the procedure goes to step (S207);

5. After step (S207), the dust quantity is detected (S208). If the dust quantity increases, then the procedure goes back to the step (S205); if not, the air purifier 100 generates fresh negative ions (S209). Alternatively, the circuit controller 52 can control the appropriate period of time and then the procedure goes to step (S209); and 6. After step (S209), the dust quantity is detected (S210). If the dust quantity increases, then the procedure goes back to the step (S205); if not, the procedure goes back to the step (S202). Alternatively, the circuit controller 52 can control the appropriate period of time and then the procedure goes to step (S202).

Therefore, by adjusting the relative distance between the discharging portion 22 and the dust collection portion 32 and switching the connection between the voltage generator and the dust collection portion 32, high or low voltages can be applied to generate and release ozone, negative ions and static electricity to collect dust corresponding to the operation mode. The air purifier according to the present invention has simple structure for easy application.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An air purifier comprising:

a main frame;

a discharging device installed in the main frame and having a discharging portion;

a dust collection device installed at a lateral side of the discharging device and having a dust collection portion, wherein the dust collection portion is capable of motion relative to the discharging portion; and a voltage generator electrically conducting the discharging portion and the dust collection portion; wherein the electrical connection between the discharging portion and the dust collection portion is selectively adjustable;

said discharging portion and dust collection portion selectively disposed in at least one of a group consisting of at least three positions relative to each other, said at least three positions comprising:

a first position wherein said discharging portion and dust collection portion are located one within the other; wherein said voltage generator selectively applies a first voltage on said discharging portion and said dust collection portion;

a second position wherein said discharging portion and said dust collection portion are substantially separated one from the other; wherein said voltage generator selectively applies a second voltage on said discharging portion;

a third position wherein said discharging portion and said dust collection portion are substantially located proximally one to the other; wherein said voltage generator selectively applies a third voltage on said discharging portion and said dust collection portion.

2. The air purifier as claimed in claim 1, wherein the discharging device includes a first framework and a second framework, wherein the first framework is arranged with a plurality of the discharging portions, and the second framework is arranged with a plurality of the dust collection portions.

3. The air purifier as claimed in claim 1, wherein the discharging portion is an elongated metal element or a metallic silk, and the dust collection portion is a hollow, cylindrical or rectangular, half closed framework.

4. The air purifier as claimed in claim 1, further including a driving mechanism disposed in the main frame, in order to move the discharging device relative to the dust collection device.

5. The air purifier as claimed in claim 4, wherein the driving mechanism includes a motor arranged on the main frame, a first driving member connected to the motor, a second driving member connected to the first driving member, a rotation member connected to the second member, and a joint member connected to the rotation member, wherein the joint member is disposed on the discharging device and the dust collection device in an alternative manner.

6. The air purifier as claimed in claim 4, further including a circuit control unit electrically connecting with the discharging device, the dust collection device and the driving mechanism.

7. The air purifier as claimed in claim 6, wherein the circuit control unit includes a sensor, a circuit controller and the voltage generator, which are arranged on the main frame respectively, and are electrically connected to one another.

8. An air purifier comprising:

a main frame;

a discharging device installed in the main frame and having a discharging portion;

a dust collection device installed at a lateral side of the discharging device and having a dust collection portion, wherein the dust collection portion is capable of motion relative to the discharging portion; and a voltage generator electrically conducting the discharging portion and the dust collection portion; wherein the electrical connection between the discharging portion and the dust collection portion is selectively adjustable;

said discharging portion and dust collection portion selectively disposed in at least one of a group consisting of at least three positions relative to each other, said at least three positions comprising:

a first position wherein said discharging portion and dust collection portion are located one within the other; wherein said voltage generator selectively applies a first voltage on said discharging portion and said dust collection portion; wherein said first voltage ionizes ambient air, producing ozone;

a second position wherein said discharging portion and said dust collection portion are substantially separated one from the other; wherein said voltage generator selectively applies a second voltage on said discharging portion;

wherein said second voltage generates concentrated negative ions;

a third position wherein said discharging portion and said dust collection portion are substantially located proximally one to the other; wherein said voltage generator selectively applies a third voltage on said discharging portion and said dust collection portion; wherein said third voltage generates static electricity, resulting in dust collection by said dust collecting portion.

9. The air purifier as claimed in claim 8, wherein the discharging device includes a first framework and a second framework, wherein the first framework is arranged with a plurality of the discharging portions, and the second framework is arranged with a plurality of the dust collection portions.

10. The air purifier as claimed in claim 8, wherein the discharging portion is an elongated metal element or a metallic silk, and the dust collection portion is a hollow, cylindrical or rectangular, half closed framework.

11. The air purifier as claimed in claim 8, further including a driving mechanism disposed in the main frame, in order to move the discharging device relative to the dust collection device.

12. The air purifier as claimed in claim 11, wherein the driving mechanism includes a motor arranged on the main frame, a first driving member connected to the motor, a second driving member connected to the first driving member, a rotation member connected to the second member, and a joint member connected to the rotation member, wherein the joint member is disposed on the discharging device and the dust collection device in an alternative manner.

13. The air purifier as claimed in claim 11, further including a circuit control unit electrically connecting with the discharging device, the dust collection device and the driving mechanism.

14. The air purifier as claimed in claim 13, wherein the circuit control unit includes a sensor, a circuit controller and the voltage generator, which are arranged on the main frame respectively, and are electrically connected to one another.

15. The air purifier as claimed in claim 8, wherein said voltage generator selectively applies a fourth voltage on said discharging portion and said dust collection portion, while in said second position; wherein said fourth voltage generates fresh negative ions.

16. An air purifier comprising:

a main frame;

a discharging device installed in the main frame and having a discharging portion;

a dust collection device installed at a lateral side of the discharging device and having a dust collection portion, wherein the dust collection portion is capable of motion relative to the discharging portion;

a voltage generator electrically conducting the discharging portion and the dust collection portion; wherein the electrical connection between the discharging portion and the dust collection portion is selectively adjustable; and a driving mechanism disposed in the main frame, in order to move the discharging device relative to the dust collection device, wherein the driving mechanism includes a motor arranged on the main frame, a first driving member connected to the motor, a second driving member connected to the first driving member, a rotation member connected to the second member, and a joint member connected to the rotation member, wherein the joint member is disposed on the discharging device and the dust collection device in an alternative manner.

17. The air purifier as claimed in claim 16, wherein the discharging device includes a first framework and a second framework, wherein the first framework is arranged with a plurality of the discharging portions, and the second framework is arranged with a plurality of the dust collection portions.

18. The air purifier as claimed in claim 16, wherein the discharging portion is an elongated metal element or a metallic silk, and the dust collection portion is a hollow, cylindrical or rectangular, half closed framework.

19. The air purifier as claimed in claim 16, further including a circuit control unit electrically connecting with the discharging device, the dust collection device and the driving mechanism.

20. The air purifier as claimed in claim 19, wherein the circuit control unit includes a sensor, a circuit controller and the voltage generator, which are arranged on the main frame respectively, and are electrically connected to one another.

* * * * *